US010529473B2

(12) United States Patent
Iwasa et al.

(10) Patent No.: US 10,529,473 B2
(45) Date of Patent: Jan. 7, 2020

(54) R-T-B BASED PERMANENT MAGNET

(71) Applicant: TDK CORPORATION, Tokyo (JP)

(72) Inventors: Takurou Iwasa, Tokyo (JP); Masashi Miwa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 197 days.

(21) Appl. No.: 15/440,667

(22) Filed: Feb. 23, 2017

(65) Prior Publication Data

US 2017/0278602 A1 Sep. 28, 2017

(30) Foreign Application Priority Data

Mar. 28, 2016 (JP) ..... 2016-063479

(51) Int. Cl.

| | |
|---|---|
| ***H01F 1/053*** | (2006.01) |
| ***B22F 9/04*** | (2006.01) |
| ***B22F 3/12*** | (2006.01) |
| ***B22F 5/00*** | (2006.01) |
| ***C21D 3/06*** | (2006.01) |
| ***C22C 38/00*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |
| ***H01F 1/06*** | (2006.01) |

(52) U.S. Cl.

CPC ..... *H01F 1/053* (2013.01); *B22F 3/12* (2013.01); *B22F 5/00* (2013.01); *B22F 9/04* (2013.01); *C21D 3/06* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *H01F 1/06* (2013.01); *B22F 2009/042* (2013.01); *B22F 2009/044* (2013.01); *B22F 2201/11* (2013.01); *B22F 2201/20* (2013.01); *B22F 2301/355* (2013.01); *B22F 2998/10* (2013.01); *B22F 2999/00* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 2010/0200121 | A1 | 8/2010 | Shintani et al. | |
| 2014/0105779 | A1 | 4/2014 | Nakamura | |
| 2014/0290803 | A1* | 10/2014 | Kato | H01F 1/0577 148/302 |

(Continued)

FOREIGN PATENT DOCUMENTS

| | | | |
|---|---|---|---|
| CN | 103779035 | A | 5/2014 |
| CN | 104078176 | A | 10/2014 |

(Continued)

*Primary Examiner* — Xiaowei Su

(74) *Attorney, Agent, or Firm* — Oliff PLC

(57) ABSTRACT

An R-T-B based permanent magnet includes R-T-B based compounds as main-phase crystal grains. R is a rare earth element. T is iron group element(s) essentially including Fe or Fe and Co. B is boron. A two-grain boundary is contained between the two adjacent main-phase crystal grains. An average grain size of the main-phase crystal grains is 0.9 μm or more and 2.8 μm or less. A thickness of the two-grain boundary is 5 nm or more and 200 nm or less.

12 Claims, 3 Drawing Sheets

(56) References Cited

U.S. PATENT DOCUMENTS

| | | | | |
|---|---|---|---|---|
| 2014/0327503 | A1* | 11/2014 | Sagawa | B22F 1/0011 335/302 |
| 2015/0170810 | A1* | 6/2015 | Miwa | C22C 38/001 75/246 |
| 2015/0221423 | A1* | 8/2015 | Mizoguchi | C22C 38/002 75/246 |
| 2016/0027564 | A1* | 1/2016 | Une | B22F 1/0044 419/30 |
| 2016/0042847 | A1* | 2/2016 | Nishiuchi | C22C 38/001 335/302 |

FOREIGN PATENT DOCUMENTS

| | | | | |
|---|---|---|---|---|
| EP | 1457998 | A1 | 9/2004 | |
| WO | WO-2013191276 | A1 * | 12/2013 | C22C 38/001 |

* cited by examiner

R-T-B BASED PERMANENT MAGNET

BACKGROUND OF THE INVENTION

1. Field of the Invention

The present invention relates to an R-T-B based permanent magnet whose main components are a rare earth element (R), at least one or more kinds of iron element essentially including Fe or Fe and Co (T), and boron (B).

2. Description of the Related Art

R-T-B based permanent magnets have excellent magnetic properties and are used for home electric appliances, various kinds of motors such as voice coil motors (VCM) of hard disk drive and motors mounted on hybrid cars, and the like. When the R-T-B based permanent magnet is used for the motor or so, it is required to have a high coercivity for responding to a use environment of high temperature.

When the R-T-B based permanent magnet is assembled in products of motors or so, this handling is difficult in a magnetized state, and thus a magnetization treatment is usually carried out after the R-T-B based permanent magnet is assembled in the products. In a state where the R-T-B based permanent magnet is assembled in the product, it is impossible to apply a large external magnetic field compared to when manufacturing the R-T-B based permanent magnet, and magnetization properties thus need to be heightened as well as coercivity.

Miniaturization of main-phase crystal grains of the R-T-B based permanent magnet is well known as a method for improving coercivity of the R-T-B based permanent magnet. This mechanism is not completely clear, but it is conceivable that the miniaturization of the main-phase crystal grains contributes to reduction of defect around crystal grain boundaries to be generation source of reverse magnetic domains. In case of miniaturization of the main-phase crystal grains, however, there is a problem of deterioration of magnetization properties.

Patent Document 1 discloses a technique for obtaining favorable coercivity and magnetization properties in a manner that a median of grain sizes of crystal grains on a cross section vertical to a c axis of an NdFeB sintered magnet is 4.5 μm or less, and that an area ratio of crystal grains whose grain sizes are 1.8 μm or less is 5% or less on the cross section. There is, however, a problem that when the main-phase crystal grains are further miniaturized, an area ratio of the crystal grains whose grain sizes are 1.8 μm or less cannot be 5% or less, and favorable magnetization properties cannot be obtained.

Patent Document 1: WO 2014/034650

Non-patent Document 1: Soshin, Chikazumi (1984) "Physics of Ferromagnetism, Vol. II": SHOKABO Co., Ltd.

SUMMARY OF THE INVENTION

The present invention has been achieved under the above circumstances. It is an object of the invention to provide favorable coercivity and magnetization properties in an R-T-B based permanent magnet having fine main-phase crystal grains.

Patent Document 1 discloses that the fact that crystal grains having grain sizes of 1.8 μm or less are single magnetic domain grains is the reason why a favorable magnetization rate is obtained in a manner that an area ratio of crystal grains having grain sizes of 1.8 μm or less is 5% or less. Multiple magnetic domain grains have a magnetization process of magnetic domain wall moving type and easily have magnetization reversal. In contrast, single magnetic domain grains have a magnetization process of magnetization rotation type and need a stronger external magnetic field for aligning the directions of magnetization than an external magnetic field for aligning the directions of magnetization needed by the multiple magnetic domain grains. In conventional R-T-B based permanent magnets, the deterioration of magnetization rate can be thus prevented only by reducing a ratio of the single magnetic domain grains having grain sizes of 1.8 μm or less, and there is a limit to miniaturization of the main-phase crystal grains.

The present inventors have earnestly studied a method for obtaining favorable magnetization properties even if the main-phase crystal grains are further miniaturized and there exist the main-phase crystal grains having grain sizes of 1.8 μm or less. As a result, the present inventors have found out that favorable magnetization properties are obtained by increasing a thickness of a two-grain boundary present between the main-phase crystal grains even if there exist fine main-phase crystal grains.

The present invention has been achieved based on the knowledge. That is, the R-T-B based permanent magnet according to the present invention is an R-T-B based permanent magnet including R-T-B based compounds as main-phase crystal grains, wherein R is a rare earth element, T is iron group element(s) essentially including Fe or Fe and Co, and B is boron, a two-grain boundary is contained between the two adjacent main-phase crystal grains, an average grain size of the main-phase crystal grains is 0.9 μm or more and 2.8 μm or less, and a thickness of the two-grain boundary is 5 nm or more and 200 nm or less.

When the two-grain boundary having such a thickness is formed, it is conceivable that the adjacent main-phase crystal grains are magnetically separated and isolated. Non-patent Document 1 shows that when the grains are magnetically isolated, there is no magnetic influence from the adjacent grains, and thus static magnetic energy becomes low and a critical size of a single magnetic domain becomes smaller compared to when the grains are not isolated. It is therefore conceivable that a thick two-grain boundary is formed among the main-phase crystal grains, and a critical size of a single magnetic domain of the main-phase crystal grains becomes small when the main-phase crystal grains are magnetically separated.

When the main-phase crystal grains have a small critical size of a single magnetic domain, even main-phase crystal grains having grain sizes to conventionally be single magnetic domain grains can exist as multiple magnetic domain grains. Thus, favorable magnetization properties can be obtained even if the main-phase crystal grains have an average grain size in the range of 0.9 μm or more and 2.8 μm or less, which is smaller than an average grain size of conventional main-phase crystal grains.

An area ratio of the main-phase crystal grains whose grain sizes are 0.6 μm or less may be 5% or less on a cut surface of the R-T-B based permanent magnet. When an area ratio of the main-phase crystal grains whose grain sizes are 0.6 μm or less is 5% or less, further favorable magnetization properties tend to be obtained. This is conceivably because the main-phase crystal grains of 0.6 μm or less are single magnetic domain grains.

The R-T-B based permanent magnet of the present invention may further include Ga, and R may be contained at 29.5 mass % or more and 35.0 mass % or less, B may be contained at 0.70 mass % or more and 0.95 mass % or less, and Ga may be contained at 0.05 mass % or more and 1.5 mass % or less.

The R-T-B based permanent magnet of the present invention may further include Al, and Al may be contained at 0.03 mass % or more and 0.4 mass % or less.

The R-T-B based permanent magnet of the present invention may further include Cu, and Cu may be contained at 0.05 mass % or more and 1.5 mass % or less.

In the R-T-B based permanent magnet of the present invention, Co may be contained at 0.1 mass % or more and 4 mass % or less.

The R-T-B based permanent magnet of the present invention may include Zr, and Zr may be contained at 0.05 mass % or more and 2.5 mass % or less.

The present invention can provide favorable coercivity and magnetization properties by controlling the thickness of the two-grain boundary in the R-T-B based permanent magnet having fine main-phase crystal grains.

DESCRIPTION OF THE PREFERRED EMBODIMENTS

Hereinafter, the present invention will be described in detail with reference to the drawings. Incidentally, the present invention is not limited to the following form for implementing the invention (hereinafter, referred to as embodiment). Components in the following embodiment include ones easily conceived by a person skilled in the art, ones that are substantially identical to, and ones belonging to a so-called equivalent scope. Furthermore, the components disclosed in the following embodiment can be appropriately combined.

The embodiment of an R-T-B based permanent magnet according to the present embodiment will be described. The R-T-B based permanent magnet according to the present embodiment is an R-T-B based permanent magnet including R-T-B based compounds as main-phase crystal grains, wherein a two-grain boundary is contained between the two adjacent main-phase crystal grains, an average grain size of the main-phase crystal grains is 0.9 μm or more and 2.8 μm or less, and a thickness of the two-grain boundary is 5 nm or more and 200 nm or less.

Figure 1:
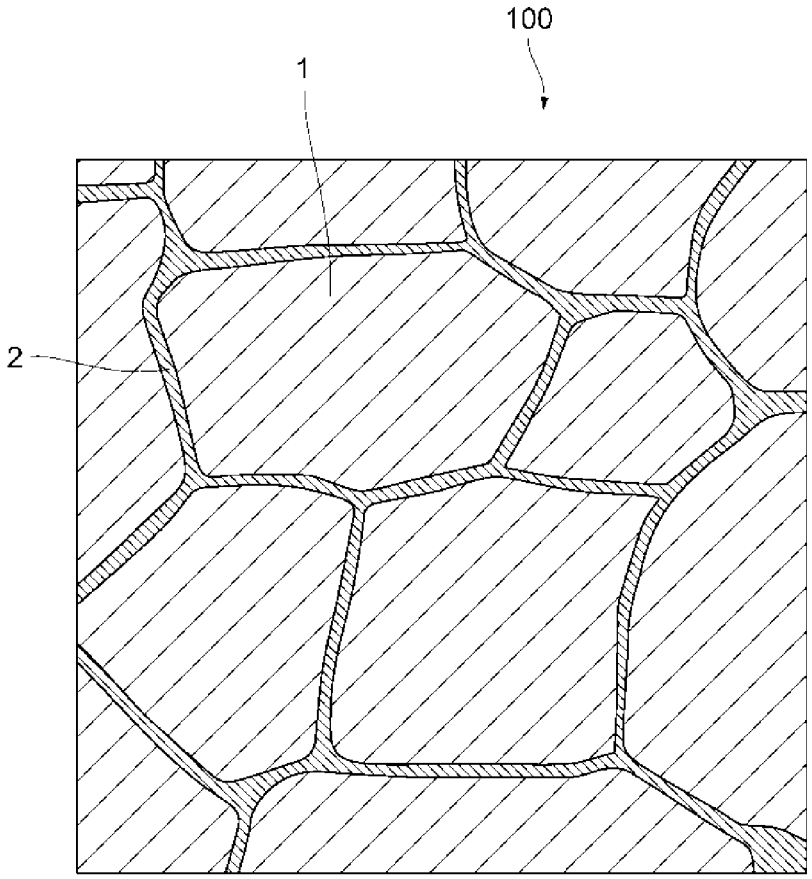
FIG. 1 is a schematic view of a cross section of an R-T-B based permanent magnet according to the present invention.

The R-T-B based permanent magnet according to the present embodiment is a sintered body formed by using an R-T-B based alloy. As shown in FIG. 1, the R-T-B based permanent magnet according to the present embodiment contains a plurality of main-phase crystal grains 2 and grain boundary phases 4 present in grain boundaries among the main-phase crystal grains.

The main-phase crystal grains 2 are composed of R-T-B based compounds. The R-T-B based compounds include an example of $R_2T_{14}B$ having a crystal structure composed of $R_2T_{14}B$ type tetragonal. The main-phase crystal grains contain R, T, and B as main components, and may contain the other elements.

R represents one or more kinds of rare earth element. Rare earth elements are Sc, Y, and lanthanoid elements belonging to Group 3 in the long-periodic table. For example, lanthanoid elements include La, Ce, Pr, Nd, Sm, Eu, Gd, Tb, Dy, Ho, Er, Tm, Yb, Lu etc. Rare earth elements are divided into light rare earth elements and heavy rare earth elements. Heavy rare earth elements represent Gd, Tb, Dy, Ho, Er, Tm, Yb, and Lu, and light rare earth elements represent the other rare earth elements.

In the present embodiment, T represents one or more kinds of iron group element containing Fe or Fe and Co. T may be only Fe, or may be Fe whose part is substituted with Co. When part of Fe is substituted with Co, temperature properties can be improved without deteriorating magnetic properties.

In the R-T-B based permanent magnet according to the present embodiment, part of B can be substituted with carbon (C). In this case, it becomes easy to manufacture the magnet and makes it possible to reduce manufacturing cost. A substitution amount of C is an amount that does not substantially affect magnetic properties.

The R-T-B based compound constituting the main-phase crystal grains 2 according to the present embodiment may contain various known additive elements, specifically, may contain at least one kind of element of Ti, V, Cu, Cr, Mn, Ni, Zr, Nb, Mo, Hf, Ta, W, Al, Ga, Si, Bi, Sn, etc.

The main-phase crystal grains according to the present embodiment have an average grain size of 0.9 μm or more and 2.8 μm or less. When the main-phase crystal grains have an average grain size in such a range, favorable coercivity and magnetization properties can be obtained. When the main-phase crystal grains have an average grain size of less than 0.9 μm, it tends to increase a ratio of the main-phase crystal grains to be single magnetic domain grains and deteriorate magnetization properties. When the main-phase crystal grains have an average grain size of more than 2.8 μm, it tends to decrease coercivity. Furthermore, the main-phase crystal grains may have an average grain size of 2.0 μm or less. In this range, a further higher coercivity can be easily obtained. Also, the main-phase crystal grains may have an average grain size of 1.1 μm or more. In this range, more favorable magnetization properties can be easily obtained. The average grain size of the main-phase crystal grains can be controlled by particle size of fine powder to be used, sintering conditions, and the like.

In the present embodiment, an average grain size of the main-phase crystal grains is obtained by analyzing a cross section of the R-T-B based permanent magnet using a means of image processing or so. Specifically, a cross sectional area of each main-phase crystal grain on the cross section of the R-T-B based permanent magnet is obtained by image analysis, and a diameter of a circle having this cross sectional area (circle equivalent diameter) is defined as a grain size of the main-phase crystal grains on the cross section. Furthermore, grain sizes with respect to all of the main-phase crystal grains present in a visual field subjected to analysis on the cross section are obtained, and an arithmetic average value represented by (a total value of the grain sizes of the main-phase crystal grains)/(the number of the main-phase crystal grains) is defined as an average grain size of the main-phase crystal grains in the R-T-B based permanent magnet. Incidentally, in case of an anisotropy magnet, a cross section that is parallel to axes of easy magnetization of the R-T-B based permanent magnet is used for analysis.

When an area ratio of the main-phase crystal grains whose grain sizes are 0.6 μm or less is 5% or less on a cut surface of the R-T-B based permanent magnet according to the present embodiment, more favorable magnetization properties can be obtained due to decrease in single magnetic domain grains. The area ratio of the main-phase crystal grains whose grain sizes are 0.6 μm or less may be 3% or less, or may be 2.6% or less. The area ratio of the main-phase crystal grains whose grain sizes are 0.6 μm or less can be controlled by a classification condition during a fine pulverization, sintering conditions, or the like. The area ratio of the main-phase crystal grains whose grain sizes are 0.6 μm or less is calculated by an image processing software after the main-phase crystal grains whose grain sizes are 0.6 μm or less are specified in the above manner. Incidentally, the main-phase crystal grains whose grain sizes are 0.6 μm or less may not exist. That is, the area ratio of the main-phase crystal grains whose grain sizes are 0.6 μm or less may be 0%. The area ratio of the main-phase crystal grains whose grain sizes are 0.6 μm or less may be 0% or more, or may be 0.04% or more.

The grain boundary phase 4 present in the grain boundary of the main-phase crystal grains according to the present embodiment contains an R-rich phase containing R more than the main-phase crystal grains. The R-rich phase may include an R-metal phase whose main component is R, an R-oxide phase, an $R_6T_{13}M$ phase ("M" is at least one kind selected from Al and Ga), and the like. The grain boundary phase 4 may contain a B-rich phase having a high blending ratio of boron (B) atoms.

The grain boundaries of the R-T-B based permanent magnet according to the present embodiment consist of two-grain boundaries formed between two main-phase crystal grains and grain boundary triple junctions formed among three or more main-phase crystal grains. In the present embodiment, the two-grain boundary has a thickness of 5 nm or more and 200 nm or less, which is significantly wider than 2 to 3 nm thickness of a two-grain boundary of an ordinary R-T-B based permanent magnet. When the two-grain boundary formed between the main-phase crystal grains of the R-T-B based permanent magnet has a thickness of less than 5 nm, magnetic separation of each of the main-phase crystal grains becomes insufficient, the main-phase crystal grains have a large critical size of a single magnetic domain, and thus it tends to decrease magnetization properties. The two-grain boundary may have a thickness of 5.0 nm or more and 197 nm or less. The two-grain boundary may have a lower thickness limit of 5.6 nm. It is not necessary for the two-grain boundary to have a thickness within such a range in all regions surrounding the main-phase crystal grains. Even if a region having a small thickness of the two-grain boundary is locally present, favorable magnetization properties can be obtained by partially containing the two-grain boundary having the above-mentioned large thickness so as to magnetically isolate the main-phase crystal grains and have a small critical size of a single magnetic domain. A ratio of two-grain boundaries having a two-grain boundary thickness of 5 nm or more may be 60% or more, and a ratio of two-grain boundaries having a two-grain boundary thickness of 5.6 nm or more may be 60% or more.

Figure 2:
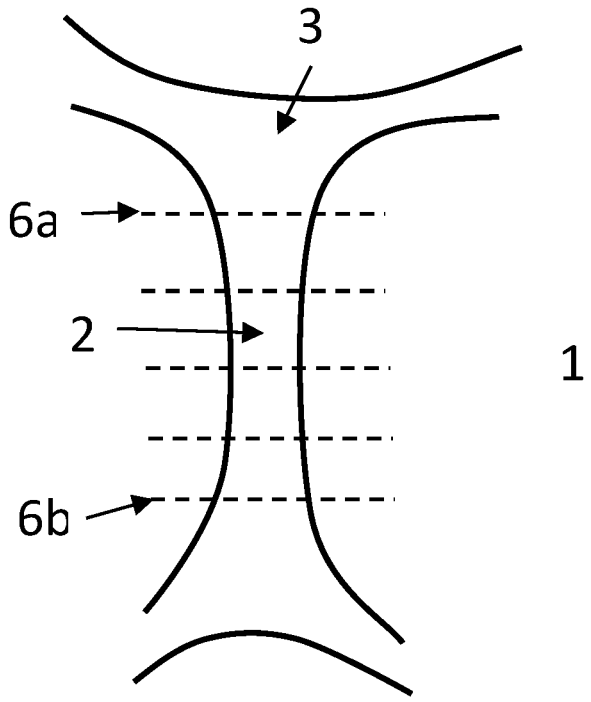
FIG. 2 is a schematic view for describing a measurement method of a two-grain boundary thickness.

The two-grain boundary thickness of the present invention is an average value of 60 measured values. FIG. 2 is a schematic view specifically showing a measurement method of the two-grain boundary thickness in the present embodiment. The two-grain boundary 6 and the grain boundary triple junction 8 are formed between the adjacent main-phase crystal grains 2. The two-grain boundary 6 subjected to measurement is focused to determine boundaries 6*a* and 6*b* between the two-grain boundary and the grain boundary triple junction 8 connected thereto. The boundaries 6*a* and 6*b* do not need to be very accurate as this vicinity is not subjected to the measurement. After the boundaries 6*a* and 6*b* are determined, the space therebetween is divided into four parts, and three equally dividing lines are drawn. The positions of the three equally dividing lines are determined as a measurement point of the two-grain boundary thickness, and three measured values are obtained. This measurement is carried out with respect to focused two-grain boundaries at randomly selected 20 points, and an average of the measured values at 60 measurement points in total is determined as the two-grain boundary thickness.

In the present invention, the ratio of two-grain boundaries having a two-grain boundary thickness of 5 nm or more is a ratio occupied by measurement points where the measured value of the two-grain boundary thickness is 5 nm or more out of the 60 measurement points where the two-grain boundary thickness is measured.

Composition of the raw material metal, conditions of the aging treatment, and the like need to be adjusted to form such a thick two-grain boundary. As described above, the main-phase crystal grains according to the present embodiment have an average grain size of 0.9 μm or more and 2.8 μm or less. When the main-phase crystal grains have an average grain size in such a range, a specific surface area of the main-phase crystal grains increases, and thus it tends to become hard to form a thick two-grain boundary. Thus, it is very important to control magnet composition and aging treatment conditions to specific conditions so as to form a thick two-grain boundary in the magnet having such small grain sizes of the main-phase crystal grains. Specifically, it becomes easier to form a thick two-grain boundary by having a shorter aging treatment time and increasing a cooling rate with a specific composition having less content of B than stoichiometric composition as shown below.

The R-T-B based permanent magnet according to the present embodiment may contain Rat 29.5 mass % or more and 35.0 mass % or less, at 31.0 mass % or more and 33.0 mass % or less, or at 31.0 mass % or more and 32.7 mass % or less. When R is contained at 29.5 mass % or more, the R-T-B based compounds to be the main phase of the R-T-B based permanent magnet are sufficiently generated. This makes it hard to deposit a-Fe having soft magnetization or so and makes it hard to decrease magnetic properties. When R is contained at a predetermined range or more, it tends to easily form a thick two-grain boundary. When R is contained at 35.0 mass % or less, a ratio of the R-T-B based compounds contained in the R-T-B based permanent magnet increases, and thus it tends to easily improve residual magnetic flux density. In the present embodiment, an amount of the heavy rare earth element contained as R may be 1.0 mass % or less in view of cost reduction and resource risk avoidance.

The R-T-B based permanent magnet according to the present embodiment may contain B at 0.70 mass % or more and 0.95 mass % or less, or may particularly contain B at 0.80 mass % or more and 0.90 mass % or less. The R-T-B based permanent magnet according to the present embodiment may contain B at 0.80 mass % or more and 0.89 mass % or less. When B is contained in a specific range that is less than stoichiometric composition of base composition represented by $R_2T_{14}B$, generation of a thick two-grain boundary can be promoted.

T is one or more kinds of iron element including Fe or Fe and Co. T may be only Fe, or may be Fe whose part is substituted with Co. The content of Fe is a substantial remaining part of constituent of the R-T-B based permanent magnet, and Fe may be partially substituted with Co. When Fe is partially substituted with Co, Co may be contained at 4 mass % or less, at 0.1 mass % or more, at 0.1 mass % or more and 2 mass % or less, at 0.3 mass % or more and 1.5 mass % or less, or at 0.5 mass % or more and 1.5 mass % or less. When Co is contained at 4 mass % or less, it tends to easily improve residual magnetic flux density. When Co is contained at 0.3 mass % or more, it tends to easily sufficiently enhance corrosion resistance.

The R-T-B based permanent magnet according to the present embodiment may contain Ga. The content of Ga may be 0.05 mass % or more and 1.5 mass % or less, 0.3 mass % or more and 1.0 mass % or less, or 0.3 mass % or more and 0.9 mass % or less. When Ga is contained in such a range, generation of a two-grain boundary can be promoted, and it is possible to achieve higher coercivity, higher corrosion resistance, and improvement in temperature properties of the magnet to be obtained. When Ga is contained at 1.5 mass % or less, it tends to easily improve residual magnetic flux density.

The R-T-B based permanent magnet according to the present embodiment may contain Cu. The content of Cu may be 0.05 mass % or more and 1.5 mass % or less, 0.2 mass % or more and 1.0 mass % or less, or 0.4 mass % or more and 1.0 mass % or less. When Cu is contained, it is possible to achieve higher coercivity, higher corrosion resistance, and improvement in temperature properties of the magnet to be obtained. When Cu is contained at 1.5 mass % or less, it tends to easily improve residual magnetic flux density. When Cu is contained at 0.05 mass % or more, it tends to improve coercivity.

The R-T-B based permanent magnet according to the present embodiment may contain Al. When Al is contained, it is possible to achieve higher coercivity, higher corrosion resistance, and improvement in temperature properties of the magnet to be obtained. The content of Al may be 0.03 mass % or more and 0.4 mass % or less, or may be 0.05 mass % or more and 0.25 mass % or less.

The R-T-B based permanent magnet according to the present embodiment may contain Zr. When Zr is contained, it is possible to prevent abnormal grain growth of the main-phase crystal grains during a manufacturing process of the permanent magnet, have a uniform and fine structure of the permanent magnet to be obtained, and improve magnetic properties. When Zr is contained, there is also an effect of stabilizing a part of excessive carbon as a ZrC phase. Zr may be contained at 0.05 mass % or more, or at 0.40 mass % or more. When Zr is contained at 0.40 mass % or more, abnormal grain growth can be easily prevented even in case of using a fine powder having a small particle size. This makes it easier to obtain a high coercivity. Zr may be contained at 2.5 mass % or less, or at 2.0 mass % or less. When Zr is contained at 2.5 mass % or less, it tends to easily improve residual magnetic flux density.

The R-T-B based permanent magnet according to the present embodiment may contain an additive element other than the above elements, such as Ti, V, Cr, Mn, Ni, Mo, Hf, Ta, W, Si, Bi, Sn, and Ca. The additive element of the above elements may be contained at 2.0 mass % or less in total provided that the entire R-T-B based permanent magnet is 100 mass %.

The R-T-B based permanent magnet according to the present embodiment may contain oxygen (O) at about 0.05 mass % or more in view of corrosion resistance. Oxygen may be contained at 0.2 mass % or less in view of magnetic properties.

The R-T-B based permanent magnet according to the present embodiment may contain carbon (C) at 0.05 mass % or more and 0.3 mass % or less. When carbon is contained at 0.3 mass % or less, it tends to improve magnetic properties of the R-T-B based permanent magnet to be obtained. When carbon is contained at 0.05 mass % or more, it tends to easily obtain orientation during pressing in a magnetic field. Carbon is mainly added by a lubricant before pressing, and a carbon amount can be thus controlled by an additive amount of the lubricant.

The R-T-B based permanent magnet according to the present embodiment may contain nitrogen (N) at 0.15 mass % or less. When N is contained in this range, it tends to easily improve coercivity. There is no lower limit to the content of N. The content of N may be 0 mass %.

The R-T-B based permanent magnet according to the present embodiment is generally machined into any shape and used. The R-T-B based permanent magnet according to the present embodiment has any shape, such as rectangular parallelepiped shape, hexahedron, flat plate, and square pillar. The R-T-B based permanent magnet according to the present embodiment may have any cross sectional shape, such as C shaped cylindrical shape. The square pillar may be one whose bottom surface is rectangular or square, for example.

The R-T-B based permanent magnet according to the present embodiment includes both magnet products that are magnetized after machining the magnet and magnet products in which the magnet is not magnetized.

<Method for Manufacturing R-T-B Based Permanent Magnet>

A method for manufacturing the R-T-B based permanent magnet according to the present embodiment will be described. The R-T-B based permanent magnet according to the present embodiment can be manufactured by a conventional powder metallurgic method. The powder metallurgic method includes: a preparing step for preparing a raw material alloy; a pulverization step for pulverizing the raw material alloy to obtain a fine powder; a pressing step for pressing the fine powder to manufacture a green compact; a sintering step for sintering the green compact to obtain a sintered body; and a heat treatment step for performing an aging treatment to the sintered body.

The preparing step is a step for preparing a raw material alloy having each element contained in the R-T-B based permanent magnet according to the present embodiment. Incidentally, a one-alloy method using one kind of alloy is described in the present embodiment, but a two-alloy method that prepares a raw material powder by casting two kinds of alloys and mixing these may be employed.

First, raw material metals having predetermined elements are prepared, and a strip casting method or so is carried out using the raw material metals. A raw material alloy can be thereby prepared. For example, the raw material metals include rare earth metals, rare earth alloys, pure iron, pure cobalt, ferroboron, or alloys of these. The raw material metals are used to prepare a raw material alloy capable of obtaining an R-T-B based permanent magnet having a desired composition.

The pulverization step is a step for obtaining a fine powder by pulverizing the raw material alloy obtained in the preparing step. The pulverization step may be carried out in two steps of a coarse pulverization step and a fine pulverization step, or may be carried out in one step. The coarse pulverization step can be carried out in an inert gas atmosphere using a stamp mill, a jaw crusher, a brown mill, or the like. In the coarse pulverization step, the raw material alloy is pulverized until a particle size becomes about several hundreds μm to several mm.

The atmosphere in each step from the pulverization step to the sintering step may be a low oxygen concentration to obtain high magnetic properties. The oxygen concentration is adjusted by controlling the atmosphere in each manufacturing step or so. When the oxygen concentration in each manufacturing step is high, the rare earth elements in the alloy powder are oxidized to easily cause an R oxide, and the R oxide is easily deposited in the grain boundary as it is without being reduced during sintering. As a result, the R-T-B based permanent magnet to be obtained easily has a decreased residual magnetic flux density Br. Thus, the oxygen concentration in each step may be 100 ppm or less, for example.

In the fine pulverization step, the coarse powder obtained in the coarse pulverization step is finely pulverized to prepare a fine powder having an average particle size of about several μm. The average particle size of the fine powder is configured based on a degree of growth of crystal grains after sintering. The fine pulverization can be carried out using a jet mill, a bead mill, or the like, for example.

When a fine powder having a small particle size is obtained using a jet mill, the surface of the pulverized powder is very active, which easily generates reaggregation of the pulverized powder and adhesion thereof to a container wall and tends to have a low yield. Thus, when the coarse powder of the alloy is finely pulverized, a fine powder can be obtained at a high yield by adding a pulverization aid of zinc stearate, oleic amide, or the like to prevent reaggregation of the powder and adhesion thereof to a container wall. A fine powder that can be oriented easily during pressing can be obtained by adding a pulverization aid. An addition amount of a pulverization aid changes based on a particle size of the fine powder and a kind of the pulverization aid to be added, but may be about 0.1% to 1% by mass %.

There is a wet pulverization method other than a dry pulverization method like a jet mill. For example, a bead mill for performing a high speed stirring using a small diameter bead can be employed as the wet pulverization method. A multiple pulverization for conducting a dry pulverization using a jet mill and further conducting a wet pulverization using a bead mill may be carried out.

The pressing step is a step for pressing the fine powder in a magnetic field to manufacture a green compact. After the fine powder is filled in a press mold arranged in an electromagnet, the pressing is specifically carried out by pressing the fine powder while applying a magnetic field due to the electromagnet so as to orient crystal axes of the fine powder. The pressing in the magnetic field is carried out in a magnetic field of 1000 to 1600 kA/m at about 30 to 300 MPa.

Incidentally, a wet pressing for pressing a slurry where the fine powder is dispersed in a solvent of oil or so can be applied to the pressing method other than a dry pressing for pressing the fine powder as it is as described above.

The sintering step is a step for sintering the green compact to obtain a sintered body. After the pressing in the magnetic field, the green compact is sintered in a vacuum or in an inert gas atmosphere, and a sintered body can be thereby obtained. The sintering conditions are appropriately determined depending upon conditions of a composition of the green compact, a pulverization method of the fine powder, powder size, and the like. For example, the sintering is carried out at 950° C. to 1050° C. for 1 to 48 hours.

The heat treatment step is a step for performing an aging treatment to the R-T-B based permanent magnet after the green compact is sintered. After the sintering, the R-T-B based permanent magnet is subjected to an aging treatment by holding the obtained the R-T-B based permanent magnet at a temperature that is lower than that of the sintering or so. After this step, a two-grain boundary thickness formed adjacent main-phase crystal grains and its composition are determined. The fine structure of these, however, is not controlled only by this step, but is determined by combination of the conditions of the sintering step, the state of the fine powder, the magnet composition, and the like. Thus, conditions of the aging treatment are determined while a relation of the magnet composition, the conditions of the aging treatment, and the fine structure of the sintered body is considered.

In the aging treatment, temperature may be in a range of 450 to 550° C., and time may be in a range of 10 to 30 minutes. When the aging treatment is carried out, the grain boundary phase changes to a liquid phase, and an outermost surface portion of the main-phase crystal grains is partially dissolved and incorporated into the liquid phase. An interface energy of the main-phase crystal grains and the liquid phase is low during the dissolution reaction of the main-phase crystal grains. When the aging time is long, the interface energy increases due to completion of the dissolution reaction of the main-phase crystal grains. Thus, the liquid phases are discharged from the two-grain boundary and concentrate on a triple junction, and the two-grain boundary thickness becomes smaller. In order to form a thick two-grain boundary, a rapid cooling needs to be performed at the stage where the interface energy of the main-phase crystal grains and the liquid phase is low, that is, at the stage where the dissolution reaction of the main-phase crystal grains is progressing. In case where the main-phase crystal grains are fined, the dissolution reactivity is increased due to increase in a specific surface area of the main-phase crystal grains, and both a shorter-time heat treatment and a faster cooling rate are needed. The cooling rate in the present embodiment may be 70° C./min or more. The two-grain boundary thickness can be controlled by variously configuring the composition of the raw material alloy, the above-mentioned sintering conditions, and the aging treatment conditions.

The aging treatment may be carried out multiple times as necessary before the above-mentioned aging treatment at a temperature of 700° C. or more and 900° C. or less.

The obtained R-T-B based permanent magnet may be machined into a desired shape as necessary. This machining method may be a shaping process, such as cutting and grinding, a chamfering process, such as barrel polishing, or the like.

There may be a step for further diffusing heavy rare earth elements to the grain boundaries of the machined R-T-B based permanent magnet. This grain boundary diffusion can be carried out by performing a heat treatment after a compound containing heavy rare earth elements is adhered on the surface of the R-T-B based permanent magnet by application, vapor deposition, or the like, or by performing a heat treatment against the R-T-B based permanent magnet in an atmosphere containing a vapor of heavy rare earth elements. This makes it possible to further improve coercivity of the R-T-B based permanent magnet.

The R-T-B based permanent magnet obtained through the above steps may be subjected to a surface treatment, such as plating, resin coating, oxidation treatment, and chemical conversion treatment. This makes it possible to further improve corrosion resistance.

Incidentally, in the present embodiment, the machining step, the grain boundary diffusion step, and the surface treatment step are performed, but these steps are not necessarily performed.

The R-T-B based permanent magnet according to the present embodiment is obtained in the above-mentioned manner, but the method for manufacturing the R-T-B based permanent magnet is not limited to the above and may be appropriately modified.

The R-T-B based permanent magnet according to the present embodiment is manufactured by sintering. That is, the R-T-B based permanent magnet according to the present embodiment is also referred to as an R-T-B based sintered magnet. The R-T-B based permanent magnet of the present invention, however, is not limited to the R-T-B based sintered magnet.

Next, the present invention will be described in more detail based on specific examples, but is not limited to the following examples.

EXAMPLES

Experimental Examples 1 to 6

First, raw material metals of an R-T-B based permanent magnet were prepared, and a raw material alloy was prepared by a strip casting method so that the R-T-B based permanent magnet having composition "A" shown in Table 1 was obtained. Incidentally, in Table 1, "bal." is a balance provided that a total composition of each alloy is 100 mass %, and "T.RE" is a total mass % of rare earth elements.

TABLE 1

| | Composition (mass %) | | | | | | | | | | | Corresponding |
|---|---|---|---|---|---|---|---|---|---|---|---|---|
| | B | Nd | Pr | Dy | T. RE | Ga | Al | Co | Cu | Zr | Fe | Examples |
| Composition "A" | 0.89 | 23.00 | 6.00 | 2.00 | 31.00 | 0.30 | 0.20 | 1.00 | 1.00 | 0.40 | bal. | 1 to 6 |
| Composition "B" | 0.80 | 32.00 | 0.00 | 0.00 | 32.00 | 0.50 | 0.20 | 1.50 | 0.60 | 1.00 | bal. | 7 to 10 |
| Composition "C" | 0.84 | 32.70 | 0.00 | 0.00 | 32.70 | 0.90 | 0.20 | 0.50 | 0.40 | 2.00 | bal. | 11 to 20 |

Next, a hydrogen pulverization treatment for storing hydrogen in the obtained raw material alloy and then performing dehydrogenation in an Ar atmosphere at 500° C. for 1 hour was carried out. Thereafter, the obtained coarse powder was cooled to a room temperature in the Ar atmosphere.

An oleic amide of 0.15 mass % as a pulverization aid was added to the obtained coarse powder of composition "A", and this was mixed. Then, a fine pulverization was performed using a jet mill. In the fine pulverization, a pulverization particle size of the fine powder was adjusted by changing a classification condition of the jet mill. In Experimental Examples 1 to 4, the fine powders were prepared so that main-phase crystal grains of the R-T-B based permanent magnet had an average grain size in a range of 2.7 μm to 2.8 μm. In Experimental Example 5, the fine powder was prepared so that main-phase crystal grains of the R-T-B based permanent magnet had an average grain size of around 3.0 μm. In Experimental Example 6, the fine powder was prepared so that main-phase crystal grains of the R-T-B based permanent magnet had an average grain size of around 3.5 μm.

In a low oxygen atmosphere, the obtained fine powder was filled in a press mold arranged in an electromagnet and pressed at 120 MPa while a magnetic field of 1200 kA/m was applied, whereby a green compact was obtained.

Thereafter, the green compact was sintered in a vacuum at 1030° C. for 12 hours and rapidly cooled.

The obtained sintered body was subjected to a two-step aging treatment in an Ar gas atmosphere. The first step (Aging 1) was performed at 850° C. for 1 hour. The second step (Aging 2) was performed by changing the treatment temperature and the treatment time so as to adjust the two-grain boundary thickness. Table 2 shows the treatment conditions of Aging 2. Thereafter, a rapid cooling was performed in the conditions shown in Table 2 so as to manufacture respective R-T-B based permanent magnets of Experimental Examples 1 to 6.

Structure and magnetic properties of the respective R-T-B based permanent magnets of Experimental Examples 1 to 6 were evaluated. As the structure, a two-grain boundary thickness on a cut surface of the R-T-B based permanent magnet and an average grain size of the main-phase crystal grains were obtained. As the magnetic properties, magnetization properties, residual magnetic flux density Br, and coercivity HcJ of the R-T-B based permanent magnets were measured.

The obtained R-T-B based permanent magnets were made into broken shape, and a polished cross section was observed using an HRTEM to evaluate the two-grain boundary thickness. The specific measuring method of the two-grain boundary thickness was as described above. Table 2 shows the two-grain boundary thicknesses of the respective R-T-B based permanent magnets of Experimental Examples 1 to 6.

The average grain size of the main-phase crystal grains with respect to the respective R-T-B based permanent magnets of Experimental Examples 1 to 6 was evaluated. The average grain size of the main-phase crystal grains was calculated from a grain size distribution obtained by polishing a cross section of a sample, observing it by a SEM, and incorporating this data to an image analysis software. Table 2 shows values of the average grain size of the main-phase crystal grains.

The composition analysis was carried out with respect to the respective R-T-B based permanent magnets of Experimental Examples 1 to 6 by an X-ray fluorescent analysis method and an inductively coupled plasma mass spectroscopic analysis method (ICP-MS method). As a result, it was confirmed that all of the R-T-B based permanent magnets had a composition approximately corresponding to a desired composition (composition shown in Table 1).

Figure 3:
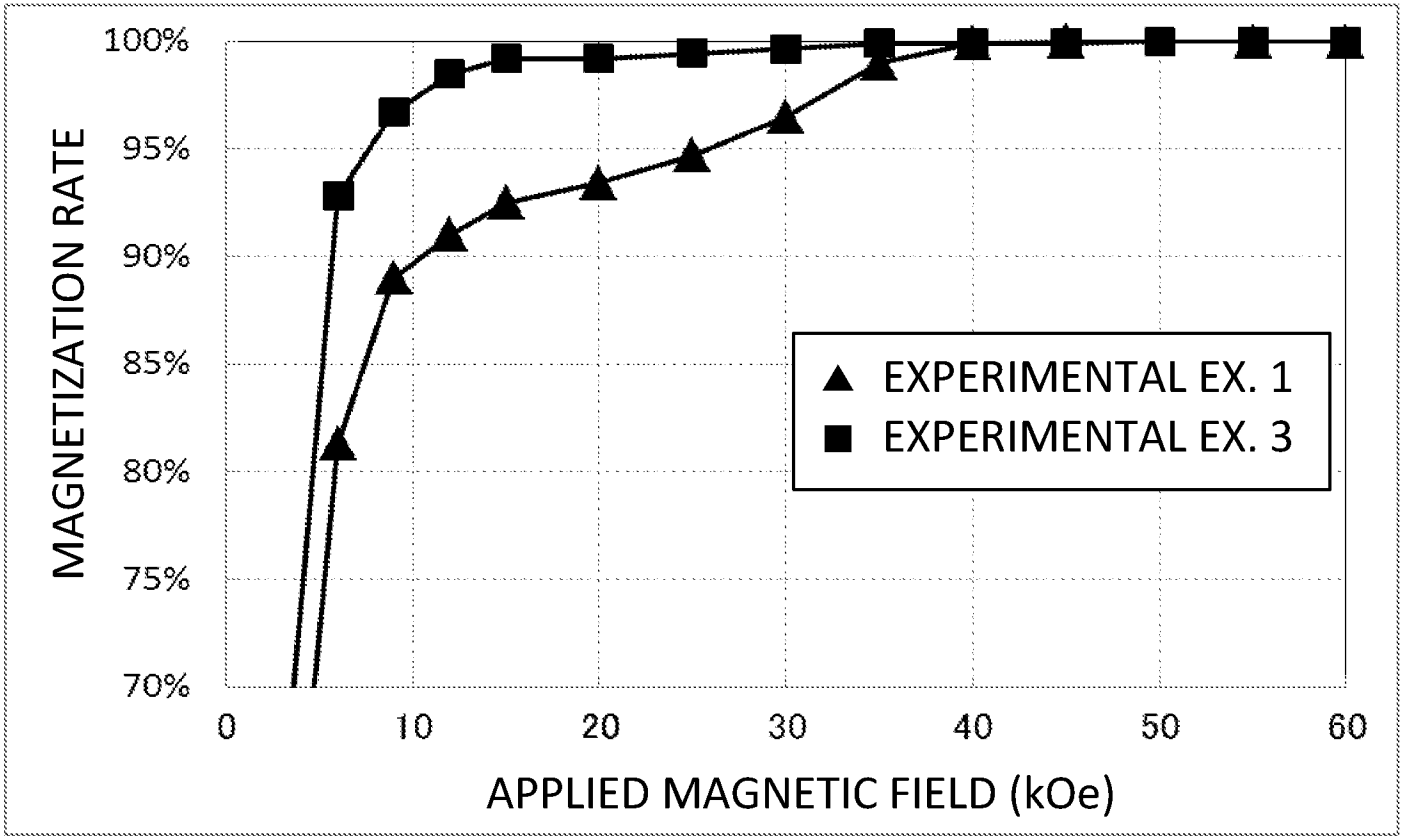
FIG. 3 is a graph showing magnetization properties of Experimental Example 1 and Experimental Example 3.

The measurement method of magnetization properties and magnetic properties was as below. First, a magnetic field of 3 kOe was applied to each of non-magnetized R-T-B based permanent magnets by a B-H tracer. Then, the magnetic field being applied was returned to zero, and a residual magnetic flux density Br at a magnetization magnetic field of 3 kOe was measured. This procedure was repeated in a manner that a magnetic field was increased by every 3 kOe magnetic field to 15 kOe, and that a magnetic field was increased by every 5 kOe magnetic field from then. Br was respectively measured at each of the magnetization magnetic fields to 25 kOe. Thereafter, a pulse magnetization was carried out in a manner that a magnetic field was increased by every 5 kOe from 30 kOe to 60 kOe, and Br was respectively measured in the same manner. A value of Br at each magnetization magnetic field divided by a value of Br at the time of pulse magnetization of 60 kOe was determined as a magnetization rate at the magnetization magnetic field. As an example, FIG. 3 shows a graph of magnetization properties of Experimental Example 1 and Experimental Example 3. When magnetization properties of Experimental Example 1 and Experimental Example 3 were compared, it was confirmed from FIG. 3 that Experimental Example 1 obtained a magnetization rate of 95% or more in case of application of 30 kOe or more, and that Experimental Example 3 obtained a magnetization rate of 95% or more at the time of 9 kOe. Table 2 shows values of magnetization rate at the time of applying a magnetic field of 15 kOe and values of Br and HcJ at the time of magnetization of 60 kOe. A magnetization rate of 95% or more at the time of applying a magnetic field of 15 kOe was determined as a favorable magnetization property, a magnetization rate of 97% or more at the time of applying a magnetic field of 15 kOe was determined as a more favorable magnetization property, and a magnetization rate of 98% or more at the time of applying a magnetic field of 15 kOe was determined as a further favorable magnetization property.

Table 2 shows Experimental Examples 1 to 4, where the main-phase crystal grains had an average grain size of 2.8 μm or less, and Experimental Examples 5 and 6, where the main-phase crystal grains had an average grain size of more than 2.8 μm. Judging from the average grain size of the main-phase crystal grains and the two-grain boundary thickness, Experimental Examples 2, 3, and 4 correspond to Examples, and the other examples correspond to Comparative Examples. Experimental Example 1, where the two-grain boundary thickness was less than 5 nm, has a low magnetization rate. In contrast, Experimental Examples 2 to 4, where the two-grain boundary thickness was 5 nm or more, have a magnetization rate of 95% or more. In Experimental Examples 5 and 6, where the main-phase crystal grains had an average grain size of more than 2.8 μm, obtained a magnetization rate of 98% or more in spite of the two-grain boundary thickness of less than 5 nm, and had no problem for a decreased magnetization rate in case of an average grain size of more than 2.8 μm, but had a lower coercivity than that of Experimental Examples 1 to 4.

TABLE 2

| | | Average | Aging 2 | | | Two-grain boundary | Magnetization rate | Magnetic properties (60 kOe magnetization) | | |
|---|---|---|---|---|---|---|---|---|---|---|
| | Composition | grain size (μm) | Temperature (° C.) | Time (min) | Cooling rate (° C./min) | thickness (nm) | (15 kOe magnetization) (%) | Br (mT) | HcJ (kA/m) | |
| Experimental Ex. 1 | "A" | 2.76 | 540 | 50 | 50 | 2.6 | 92.7 | 1332 | 1712 | Comp. Ex. |
| Experimental Ex. 2 | | 2.73 | 540 | 20 | 70 | 5.6 | 98.8 | 1346 | 1760 | Ex. |
| Experimental Ex. 3 | | 2.80 | 520 | 10 | 90 | 63 | 99.1 | 1350 | 1781 | Ex. |
| Experimental Ex. 4 | | 2.75 | 490 | 25 | 100 | 89 | 99.5 | 1351 | 1783 | Ex. |
| Experimental Ex. 5 | | 3.02 | 560 | 50 | 30 | 2.2 | 98.6 | 1323 | 1606 | Comp. Ex. |
| Experimental Ex. 6 | | 3.50 | 560 | 60 | 30 | 2.4 | 99.2 | 1330 | 1550 | Comp. Ex. |

Experimental Examples 7 to 10

Raw materials were blended so that an R-T-B based permanent magnet of composition "B" shown in Table 1 was obtained, and casting of a raw material alloy and a hydrogen pulverization treatment were carried out in the same manner as Experimental Example 1.

An oleic amide of 0.4 mass % as a pulverization aid was added to the obtained coarse powder of composition "B", and this was mixed. Then, a fine pulverization was performed using a jet mill. A classification condition was adjusted in the same manner as Experimental Example 1, and a fine powder was prepared so that the main-phase crystal grains of the R-T-B based permanent magnet had an average grain size of 1.5 to 1.6 μm.

Pressing, sintering, and aging treatment were performed to the obtained fine powder in the same manner as Experimental Example 1, and respective R-T-B based permanent magnets of Experimental Examples 7 to 10 were obtained. Table 3 shows treatment conditions of Aging 2.

As is the case with Experimental Example 1, Table 3 shows evaluation results of the two-grain boundary thickness, the average grain size of the main-phase crystal grains, the magnetization rate where a magnetic field of 15 kOe was applied, and magnetic properties with respect to the respective R-T-B based permanent magnets obtained in Experimental Examples 7 to 10.

As a result of composition analysis performed in the same manner as Experimental Example 1 with respect to the respective R-T-B based permanent magnets obtained in Experimental Examples 7 to 10, it was confirmed that all of the R-T-B based permanent magnets had a composition approximately corresponding to a desired composition (composition shown in Table 1).

Judging from the two-grain boundary thickness shown in Table 3, Experimental Examples 8, 9, and 10 correspond to Examples, and the other experimental example corresponds to Comparative Example. Experimental Example 7, where the two-grain boundary thickness was less than 5 nm, has a low magnetization rate. In contrast, Experimental Examples 8 to 10, where the two-grain boundary thickness was 5 nm or more, had a magnetization rate of 95% or more.

TABLE 3

| | Composition | Average grain size (μm) | Aging 2 Temperature (° C.) | Aging 2 Time (min) | Aging 2 Cooling rate (° C./min) | Two-grain boundary thickness (nm) | Magnetization rate (15 kOe magnetization) (%) | Magnetic properties (60 kOe magnetization) Br (mT) | Magnetic properties (60 kOe magnetization) HcJ (kA/m) | |
|---|---|---|---|---|---|---|---|---|---|---|
| Experimental Ex. 7 | "B" | 1.52 | 530 | 40 | 40 | 4.1 | 91.6 | 1340 | 1690 | Comp. Ex. |
| Experimental Ex. 8 | | 1.53 | 530 | 15 | 80 | 6.2 | 97.8 | 1352 | 1715 | Ex. |
| Experimental Ex. 9 | | 1.51 | 500 | 20 | 90 | 102 | 98.8 | 1354 | 1738 | Ex. |
| Experimental Ex. 10 | | 1.56 | 490 | 10 | 100 | 164 | 99.2 | 1360 | 1741 | Ex. |

Experimental Examples 11 to 20

Raw materials were blended so that an R-T-B based permanent magnet of composition "C" shown in Table 1 was obtained, and casting of a raw material alloy and a hydrogen pulverization treatment were carried out in the same manner as Experimental Example 1.

In Experimental Examples 11 to 20, Experimental Examples 11 to 15, where a dry pulverization was carried out using a jet mill, and Experimental Examples 16 to 20, where a wet pulverization was further carried out using a bead mill after the dry pulverization was carried out, were compared in terms of a fine pulverization method.

An oleic amide of 0.8 mass % as a pulverization aid was added to the obtained coarse powder of composition "C", and this was mixed. Then, a fine pulverization was performed as a dry pulverization using a jet mill. In the fine pulverization, a classification condition of the jet mill was changed to adjust a pulverization particle size of the fine powder and adjust the average grain size of the main-phase crystal grains. Furthermore, pressing, sintering, and aging treatment were performed to the obtained fine powder in the same manner as Experimental Example 1, and respective R-T-B based permanent magnets of Experimental Examples 11 to 15 were obtained. Table 4 shows treatment conditions of Aging 2.

An oleic amide of 0.15 mass % as a pulverization aid was added to the obtained coarse powder of composition "C", and this was mixed. Then, a fine pulverization was performed as a wet pulverization using a jet mill until a particle size of D50 was 4.0 μm. Furthermore, the finely pulverized powder using the jet mill was subjected to a fine pulverization using a bead mill. In the pulverization by the bead mill, a zirconia bead having a diameter of 0.8 mm was used, and an n-paraffin was used as a solvent. In the fine pulverization by the bead mill, the pulverization time of the bead mill was changed to adjust a pulverization particle size of the fine powder and adjust the average grain size of the main-phase crystal grains.

The obtained fine powder was filled in slurry form in a press mold arranged in an electromagnet and pressed at 120 MPa while a magnetic field of 1200 kA/m was applied, whereby a green compact was obtained. Furthermore, the obtained green compact was subjected to desolvation in a vacuum at 180° C. for 2 hours, and thereafter subjected to sintering and an aging treatment in the same manner as Experimental Example 1, whereby respective R-T-B based permanent magnets of Experimental Examples 16 to 20 were obtained. Table 4 shows treatment conditions of Aging 2.

As is the case with Experimental Example 1, Table 4 shows evaluation results of the two-grain boundary thickness, the average grain size of the main-phase crystal grains, the magnetization rate where a magnetic field of 15 kOe was applied, and magnetic properties with respect to the respective R-T-B based permanent magnets obtained in Experimental Examples 11 to 20.

In the respective R-T-B based permanent magnets obtained in Experimental Examples 11 to 20, a fracture surface was observed using a SEM, and an area ratio of main-phase crystal grains having grain sizes of 0.6 μm or less was thereafter calculated using an image processing software. Table 4 shows the area ratio of main-phase crystal grains having grain sizes of 0.6 μm or less in the respective R-T-B based permanent magnets obtained in Experimental Examples 11 to 20.

As a result of composition analysis performed in the same manner as Experimental Example 1 with respect to the respective R-T-B based permanent magnets obtained in Experimental Examples 11 to 20, it was confirmed that all of the R-T-B based permanent magnets had a composition approximately corresponding to a desired composition (composition shown in Table 1).

Judging from the average grain size of the main-phase crystal grains shown in Table 4, Experimental Examples 12 to 15, Experimental Examples 17 to 20, and Experimental Example 17a correspond to Examples, and the other experimental examples correspond to Comparative Examples. When the dry pulverization and the wet pulverization are compared, Experimental Examples 16 to 20 made by the wet pulverization have a larger area ratio of the main-phase crystal grains having a grain size of 0.6 μm or less than that of Experimental Examples 11 to 15 made by the dry pulverization. This is conceivably because in the wet pulverization, the particles break from their end and become extremely fine particles, and the extremely fine particles become the main-phase crystal grains having a grain size of 0.6 μm or less after being sintered. Experimental Examples 11 and 16, both of which are Comparative Examples whose main-phase crystal grains have the average grain size of less than 0.9 have a low magnetization rate even though the two-grain boundary thickness was 5 nm or more. A favorable magnetization rate was obtained in Experimental Examples 12 to 15, Experimental Examples 17 to 20, and Experimental Example 17a, all of which are Examples whose main-phase crystal grains have the average grain size of 0.9 μm or more and 2.8 μm or less. A further favorable magnetization rate was obtained in Experimental Examples 13 to 15 and Experimental Examples 18 to 20, all of which are Examples whose main-phase crystal grains have the average grain size of 1.1 μm or more. It was also confirmed that Experimental Example 12, where the area ratio of the main-phase crystal grains having grain sizes of 0.6 μm or less was 5% or less, has a more favorable magnetization rate than that of Experimental Example 17, where the area ratio was more than 5%.

TABLE 4

| | Composition | Pulverization manner | Average grain size (μm) | Aging 2 Temperature (° C.) | Aging 2 Time (min) | Aging 2 Cooling rate (° C./min) | Two-grain boundary thickness (nm) | Area ratio (%) | Magnetization rate (15 kOe magnetization) (%) | Magnetic properties (60 kOe magnetization) Br (mT) | Magnetic properties (60 kOe magnetization) HcJ (kA/m) | |
|---|---|---|---|---|---|---|---|---|---|---|---|---|
| Experimental Ex. 11 | "C" | Dry | 0.80 | 500 | 20 | 80 | 7.1 | 6.3 | 93.6 | 1265 | 1841 | Comp. Ex. |
| Experimental Ex. 12 | | | 0.90 | 500 | 20 | 80 | 32 | 4.0 | 97.4 | 1275 | 1858 | Ex. |
| Experimental Ex. 13 | | | 1.12 | 500 | 20 | 80 | 100 | 2.1 | 99.2 | 1298 | 1821 | Ex. |
| Experimental Ex. 14 | | | 1.96 | 500 | 20 | 80 | 137 | 0.1 | 99.4 | 1295 | 1791 | Ex. |
| Experimental Ex. 15 | | | 2.68 | 500 | 20 | 80 | 180 | 0.04 | 99.6 | 1300 | 1754 | Ex. |
| Experimental Ex. 16 | | Wet | 0.82 | 500 | 20 | 80 | 34 | 7.8 | 92.3 | 1286 | 1825 | Comp. Ex. |
| Experimental Ex. 17 | | | 0.93 | 500 | 20 | 80 | 80 | 5.5 | 95.6 | 1302 | 1835 | Ex. |
| Experimental Ex. 17a | | | 0.99 | 500 | 20 | 80 | 91 | 5.0 | 97.0 | 1306 | 1816 | Ex. |
| Experimental Ex. 18 | | | 1.07 | 500 | 20 | 80 | 112 | 2.6 | 98.9 | 1312 | 1804 | Ex. |
| Experimental Ex. 19 | | | 1.98 | 500 | 20 | 80 | 153 | 0.2 | 99.2 | 1316 | 1778 | Ex. |
| Experimental Ex. 20 | | | 2.73 | 500 | 20 | 80 | 197 | 0.1 | 99.7 | 1317 | 1740 | Ex. |

The present invention has been described based on the embodiment. The embodiment is just an example, and a person skilled in the art understands that variations and modifications can be made in the scope of the claims of the present invention, and that such variations and modifications are within the claims of the present invention. Therefore, the description and the drawings in the present specification should not be dealt with in a limited manner but in an illustrative manner.

INDUSTRIAL APPLICABILITY

The present invention can provide favorable coercivity and magnetization properties by controlling the thickness of the two-grain boundary in the R-T-B based permanent magnet having fine main-phase crystal grains.

NUMERICAL REFERENCES

2 main-phase crystal grain
4 grain boundary phase
6 two-grain boundary
6*a*, 6*b* boundary
8 grain boundary triple junction

The invention claimed is:

1. An R-T-B based permanent magnet comprising R-T-B based compounds as main-phase crystal grains, wherein
R is a rare earth element, T is iron group element(s) comprising Fe or Fe and Co, and B is boron,
a two-grain boundary is contained between the two adjacent main-phase crystal grains,
an average grain size of the main-phase crystal grains is 0.90 μm or more and 2.80 μm or less,
a thickness of the two-grain boundary is 5 nm or more and 200 nm or less, and
an area ratio of the main-phase crystal grains whose grain sizes are 0.6 μm or less is 5% or less on a cut surface of the R-T-B based permanent magnet.

2. The R-T-B based permanent magnet according to claim 1, further comprising Ga, wherein
R is contained at 29.5 mass % or more and 35.0 mass % or less,
B is contained at 0.70 mass % or more and 0.95 mass % or less, and
Ga is contained at 0.05 mass % or more and 1.5 mass % or less.

3. The R-T-B based permanent magnet according to claim 1, further comprising Al, wherein
Al is contained at 0.03 mass % or more and 0.4 mass % or less.

4. The R-T-B based permanent magnet according to claim 1, further comprising Cu, wherein
Cu is contained at 0.05 mass % or more and 1.5 mass % or less.

5. The R-T-B based permanent magnet according to claim 1, wherein
Co is contained at 0.1 mass % or more and 4 mass % or less.

6. The R-T-B based permanent magnet according to claim 1, further comprising Zr, wherein
Zr is contained at 0.05 mass % or more and 2.5 mass % or less.

7. The R-T-B based permanent magnet according to claim 1, wherein
the thickness of the two-grain boundary is 32 nm or more and 200 nm or less.

8. The R-T-B based permanent magnet according to claim 1, wherein
the area ratio of the main-phase crystal grains whose grain sizes are 0.6 μm or less is 3% or less on a cut surface of the R-T-B based permanent magnet.

9. The R-T-B based permanent magnet according to claim 8, wherein the area ratio is 2.6% or less.

10. The R-T-B based permanent magnet according to claim 8, wherein the area ratio is 0%.

11. The R-T-B based permanent magnet according to claim 1, wherein the average grain size of the main-phase crystal grains is 0.90 μm or more and 2.73 μm or less.

12. The R-T-B based permanent magnet according to claim 1, wherein the thickness of the two-grain boundary is 5.6 nm or more and 153 nm or less.

* * * * *